US008733030B2

(12) United States Patent
Rasmussen et al.

(10) Patent No.: US 8,733,030 B2
(45) Date of Patent: May 27, 2014

(54) ROOFING CORBEL

(71) Applicant: Quality Edge, Inc, Walker, MI (US)

(72) Inventors: Craig Scott Rasmussen, Ada, MI (US); Paul W. Vander Laan, Hamilton, MI (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 13/947,663

(22) Filed: Jul. 22, 2013

(65) Prior Publication Data

US 2013/0298479 A1 Nov. 14, 2013

Related U.S. Application Data

(63) Continuation of application No. 13/414,131, filed on Mar. 7, 2012, now Pat. No. 8,555,560.

(51) Int. Cl.
*E04B 7/00* (2006.01)

(52) U.S. Cl.
USPC ..... 52/94; 52/287.1

(58) Field of Classification Search
USPC ..... 52/94–96, 100, 716.1, 287.1, 288.1, 52/101, 57
See application file for complete search history.

(56) References Cited

U.S. PATENT DOCUMENTS 3,415,019 A * 12/1968 Andersen ..... 52/94
3,983,666 A 10/1976 Gellert
3,984,952 A 10/1976 Loomis
4,050,277 A 9/1977 Malott et al.
4,187,037 A 2/1980 Seiz et al.
4,200,034 A 4/1980 Listle et al.
4,461,128 A * 7/1984 Knoebl ..... 52/94
4,479,916 A 10/1984 Blatchford
4,548,487 A 10/1985 Nielsen
4,558,637 A 12/1985 Mason
4,578,921 A 4/1986 Cazaly et al.
4,608,787 A 9/1986 Carlson
4,660,336 A 4/1987 Cazaly et al.
4,679,923 A 7/1987 Nielsen
4,739,603 A 4/1988 Butler
4,807,409 A 2/1989 Sells
4,891,917 A 1/1990 Lerstol
5,050,489 A 9/1991 Mankowski
5,096,155 A 3/1992 Fitzgerald
5,167,579 A 12/1992 Rotter
5,238,450 A 8/1993 Rotter
5,425,672 A 6/1995 Rotter
5,634,308 A 6/1997 Doolan
5,646,378 A 7/1997 Van Haaff et al.

(Continued)

*Primary Examiner* — Jeanette E Chapman
*Assistant Examiner* — Daniel Kenny
(74) *Attorney, Agent, or Firm* — Price Heneveld LLP

(57) ABSTRACT

A soffit enclosure for building roofs and the like of the type having at least one eave with a soffit thereunder. A first mounting member is attached to an adjacent exterior wall of the building and a second mounting member is disposed on a roof fascia of the building. The first and second mounting members support a plurality of soffit panels thereon. A decorative corbel member has a generally flat upper mounting portion with opposite end edges, a decorative lower portion shaped to enhance the appearance of the eave of the building, and first and second rigid hanger tabs disposed above and generally parallel with the mounting portion. The hanger tabs project longitudinally from the opposite end edges of the upper mounting portion and are configured for sequentially inserting into the first and second mounting members. The corbel member overlies adjacent soffit panel to conceal a joint disposed therebetween.

11 Claims, 10 Drawing Sheets

(56) References Cited

U.S. PATENT DOCUMENTS

| | | | |
|---|---|---|---|
| 5,657,585 | A | 8/1997 | Zaccagni |
| 5,711,117 | A | 1/1998 | Zaccagni et al. |
| 5,718,086 | A | 2/1998 | Dunn |
| 5,728,000 | A | 3/1998 | Bateman |
| 5,826,394 | A | 10/1998 | Barton, Jr. et al. |
| 5,896,609 | A | 4/1999 | Lin |
| 5,911,180 | A | 6/1999 | Mullens |
| 5,921,511 | A | 7/1999 | LaPointe |
| 5,947,817 | A | 9/1999 | Morris et al. |
| 5,950,321 | A | 9/1999 | Pena et al. |
| 5,960,595 | A | 10/1999 | McCorsley, III et al. |
| 5,971,848 | A | 10/1999 | Nair et al. |
| 6,015,343 | A | 1/2000 | Castillo et al. |
| 6,056,083 | A | 5/2000 | Daniell |
| 6,105,330 | A | 8/2000 | Nanayakkara |
| 6,149,516 | A | 11/2000 | Mantyla |
| 6,286,273 | B1 | 9/2001 | Villela et al. |
| 6,324,810 | B1 | 12/2001 | Thompson |
| 6,343,985 | B1 | 2/2002 | Smith |
| 6,347,487 | B1 | 2/2002 | Davis |
| 6,363,994 | B1 | 4/2002 | Roberts et al. |
| 6,368,022 | B1 | 4/2002 | Zingerman |
| 6,450,882 | B1 | 9/2002 | Morris et al. |
| 6,474,037 | B2 | 11/2002 | Thompson |
| 6,484,468 | B2 | 11/2002 | Thompson |
| 6,487,826 | B1 | 12/2002 | McCorsley et al. |
| 6,550,208 | B2 | 4/2003 | Nanayakkara |
| 6,565,431 | B1 | 5/2003 | Villela |
| 6,588,165 | B1 | 7/2003 | Wright |
| 6,623,354 | B2 | 9/2003 | Morris et al. |
| 6,751,920 | B2 | 6/2004 | Thompson |
| 6,754,995 | B1 | 6/2004 | Davis et al. |
| 6,808,338 | B2 | 10/2004 | Zingerman |
| 6,877,284 | B2 | 4/2005 | Thompson |
| 6,913,530 | B2 | 7/2005 | Morris et al. |
| 6,955,010 | B2 | 10/2005 | Martin |
| 6,981,824 | B2 | 1/2006 | Zingerman |
| D525,720 | S | 7/2006 | Ellsley |
| 7,134,252 | B2 | 11/2006 | Thompson |
| 7,137,224 | B2 | 11/2006 | Rasmussen et al. |
| 7,179,165 | B2 | 2/2007 | Cook |
| 7,204,060 | B2 | 4/2007 | Hunt |
| 7,353,144 | B1 | 4/2008 | Rinks et al. |
| 7,389,255 | B2 | 6/2008 | Formisano |
| 7,393,273 | B2 | 7/2008 | Ehrman et al. |
| 7,487,623 | B2 | 2/2009 | Rodolofo et al. |
| 7,537,518 | B2 | 5/2009 | Villela et al. |
| 7,581,359 | B2 * | 9/2009 | Bukeavich ..... 52/101 |
| D604,539 | S | 11/2009 | Kennedy et al. |
| D608,625 | S | 1/2010 | Mercado |
| 7,644,545 | B2 | 1/2010 | Mankell et al. |
| 7,654,051 | B2 | 2/2010 | Pollack |
| 7,730,762 | B2 | 6/2010 | Xia |
| 7,975,447 | B1 * | 7/2011 | Vanden Bosch et al. .... 52/311.2 |

* cited by examiner

ROOFING CORBEL

CROSS-REFERENCE TO RELATED APPLICATION

This application is a continuation of and claims priority to U.S. patent application Ser. No. 13/414,131 (now U.S. Pat. No. 8,555,560), filed on Mar. 7, 2012, entitled "ROOFING CORBEL," the entire disclosure of which is hereby incorporated herein by reference.

BACKGROUND OF THE INVENTION

The present invention generally relates to soffits for building roofs, and more specifically, to a soffit enclosure with a decorative corbel member that can be installed without fasteners to an eave of a building.

SUMMARY OF THE PRESENT INVENTION

One aspect of the present invention includes a soffit enclosure for building roofs and the like of the type having at least one eave with a soffit thereunder. A plurality of generally flat soffit panels each have a generally rectangular plan configuration with opposite first marginal edge portions and opposite second marginal edge portions. The soffit panels are shaped to enclose at least a portion of the soffit when mounted in a generally horizontal orientation under the eave. A first mounting member is shaped to be attached to an adjacent exterior wall of the building. The first mounting member is configured to support thereon one of the first marginal edge portions of the soffit panels such that the adjacent second marginal edge portions of the soffit panels come together along joint lines oriented generally perpendicular to the lengthwise dimension of the soffit. A roof fascia of the building includes a second mounting member, which is configured to support thereon the other of the first marginal edge portions of the soffit panels such that the adjacent second marginal edge portions of the soffit panels come together along the joint lines. At least one corbel member has a generally flat upper mounting portion with opposite end edges. A decorative lower portion is shaped to enhance the appearance of the eave of the building. First and second rigid hanger tabs are disposed above and generally parallel with the mounting portion projecting longitudinally from the opposite end edges of the upper mounting portion. The first and second rigid hanger tabs are configured for sequentially inserting into the first and second mounting members at a location overlying adjacent ones of the second marginal edge portions of the soffit panel to conceal a joint disposed therebetween.

Another aspect of the present invention includes a soffit enclosure for building roofs and the like of the type having at least one soffit panel mounted in a generally horizontal orientation under an associated building eave between a first mounting member attached to an adjacent exterior wall of a building, and an oppositely disposed second mounting member disposed on a roof fascia. The improvement of a decorative corbel includes a generally flat upper mounting portion with opposite end edges. A decorative lower portion is shaped to enhance the appearance of the eave of the building. First and second rigid hanger tabs are disposed above and generally parallel with the mounting portion projecting longitudinally from the opposite end edges of the mounting surface and configured for sequentially inserting into the first and second mounting members. The decorative corbel has a predetermined length, which is generally commensurate with the widthwise distance between the first and second mounting members. The first and second rigid hanger tabs are configured such that the first rigid hanger tab is inserted into one of the first and second mounting members with the decorative corbel in an initial installation orientation that is skewed relative to the lengthwise dimension of the building eave. Rotation of the decorative corbel generally about the first rigid hanger tab from the skewed initial installation position to a fully installed orientation that is generally perpendicular with the lengthwise dimension of the building eave causes the second rigid hanger tab to be inserted into the other of the first and second mounting members to define a fastenerless twist into place assembly in which the decorative corbel is supported in a suspended fashion by and between the first and second mounting members.

Yet another aspect of the present invention includes a decorative corbel for building soffit enclosures and the like of the type having at least one soffit panel mounted in a generally horizontal orientation under an associated building eave between a first mounting member attached to an adjacent exterior wall of a building, and an oppositely disposed second mounting member disposed on a roof fascia. The decorative corbel includes a generally flat upper mounting portion having opposite end edges. A decorative lower portion is shaped to enhance the appearance of the eave of the building. First and second rigid hanger tabs are disposed above and are generally parallel with the mounting portion projecting longitudinally from the opposite end edges of the mounting surface and configured for sequentially inserting into the first and second mounting members. The decorative corbel has a predetermined length, which is generally commensurate with the widthwise distance between the first and second mounting members. The first and second rigid hanger tabs are configured such that the first rigid hanger tab is inserted into one of the first and second mounting members with the decorative corbel in an initial installation orientation that is skewed relative to the lengthwise dimension of the building eave. Rotation of the decorative corbel generally about the first rigid hanger tab from the skewed initial installation position to a fully installed orientation that is generally perpendicular with the lengthwise dimension of the building eave causes the second rigid hanger tab to be inserted into the other of the first and second mounting members to define a fastenerless twist into place assembly in which the decorative corbel is supported in a suspended fashion by and between the first and second mounting members.

These and other aspects, objects, and features of the present invention will be understood and appreciated by those skilled in the art upon studying the following specification, claims, and appended drawings.

DETAILED DESCRIPTION OF EMBODIMENTS

Figure 1:
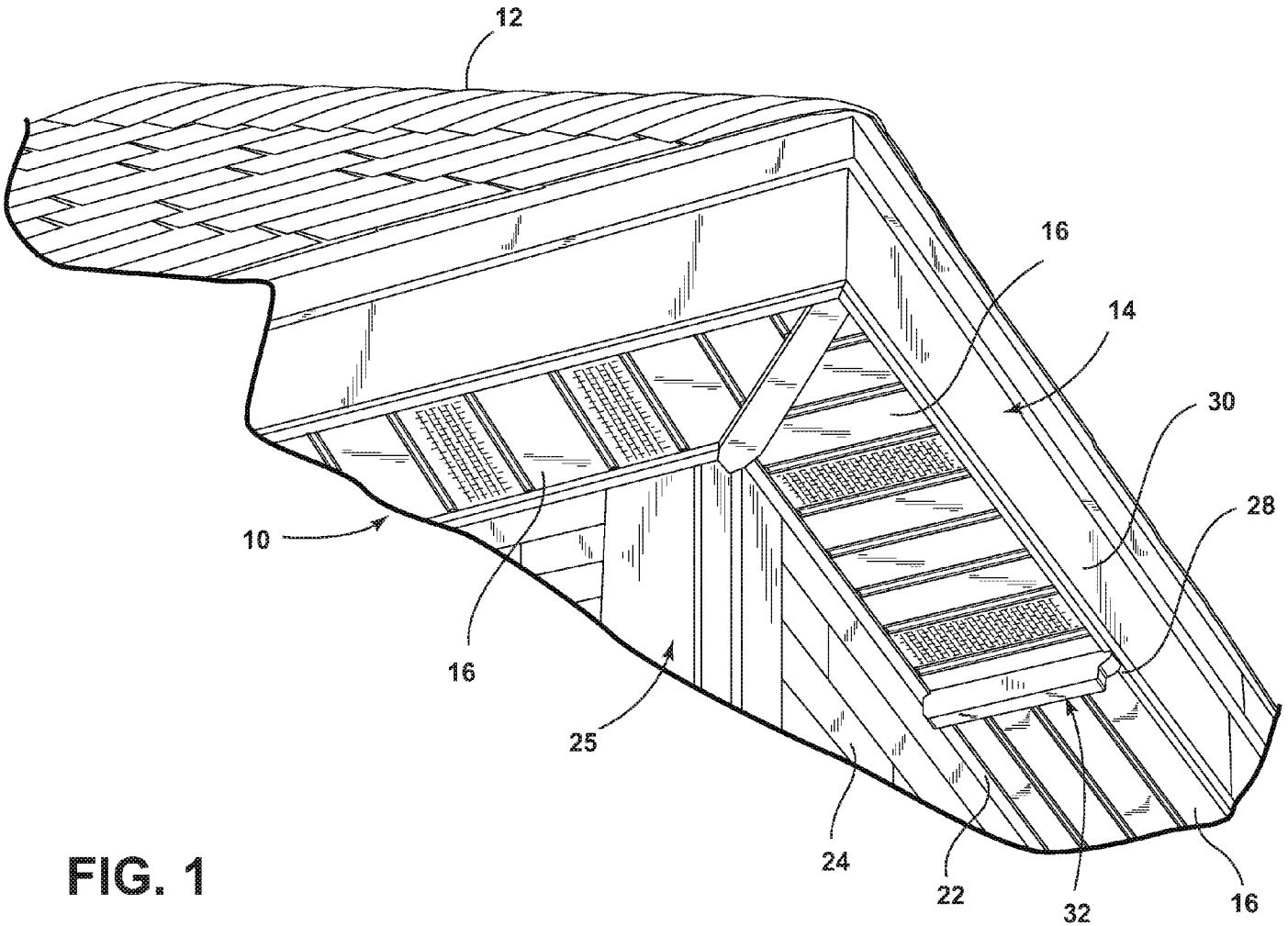
FIG. 1 is a bottom perspective view of one embodiment of a roofing corbel of the present invention installed on a building.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
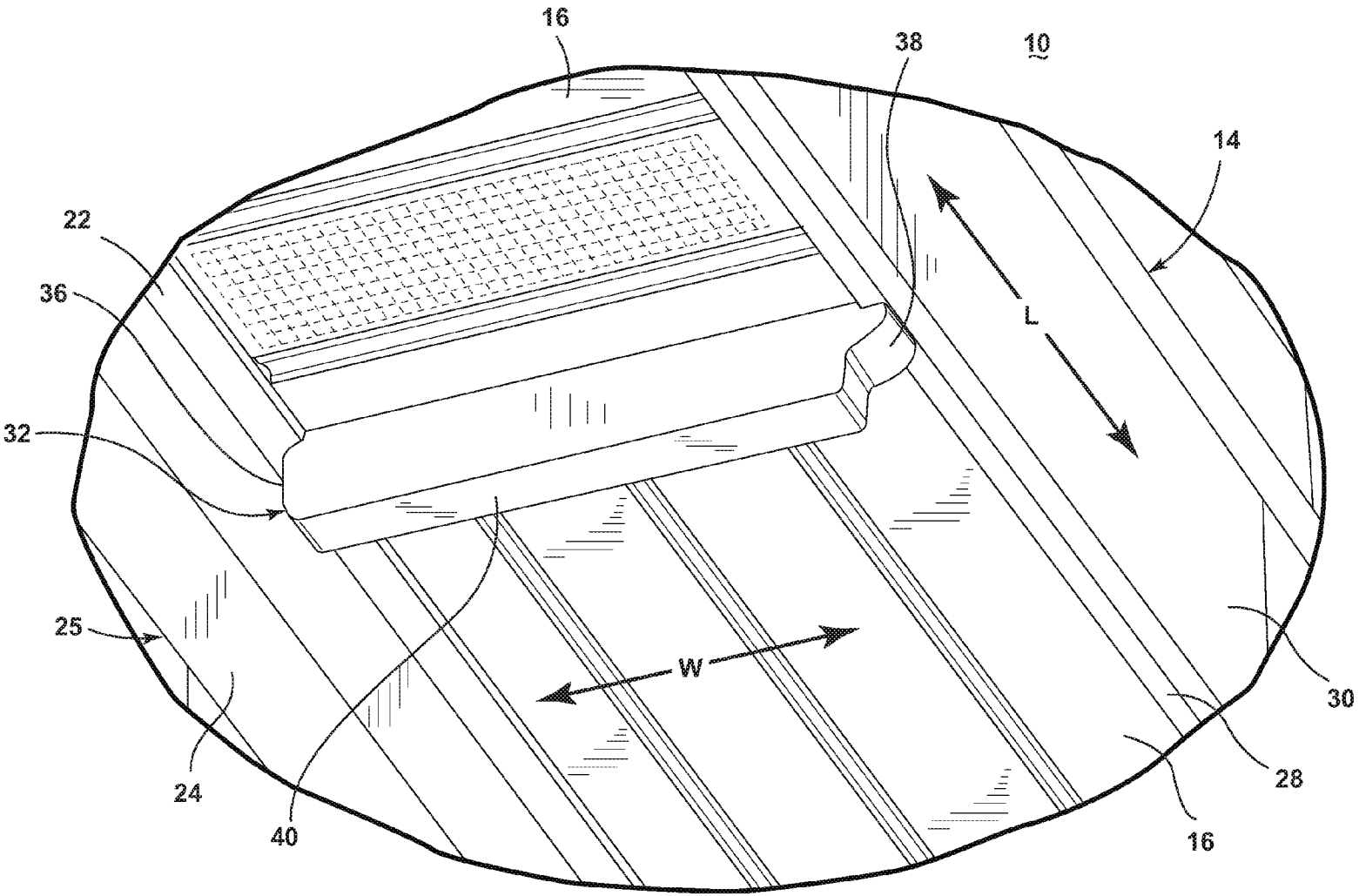
FIG. 2 is an enlarged bottom perspective view of the roofing corbel of FIG. 1.
Figure 3:
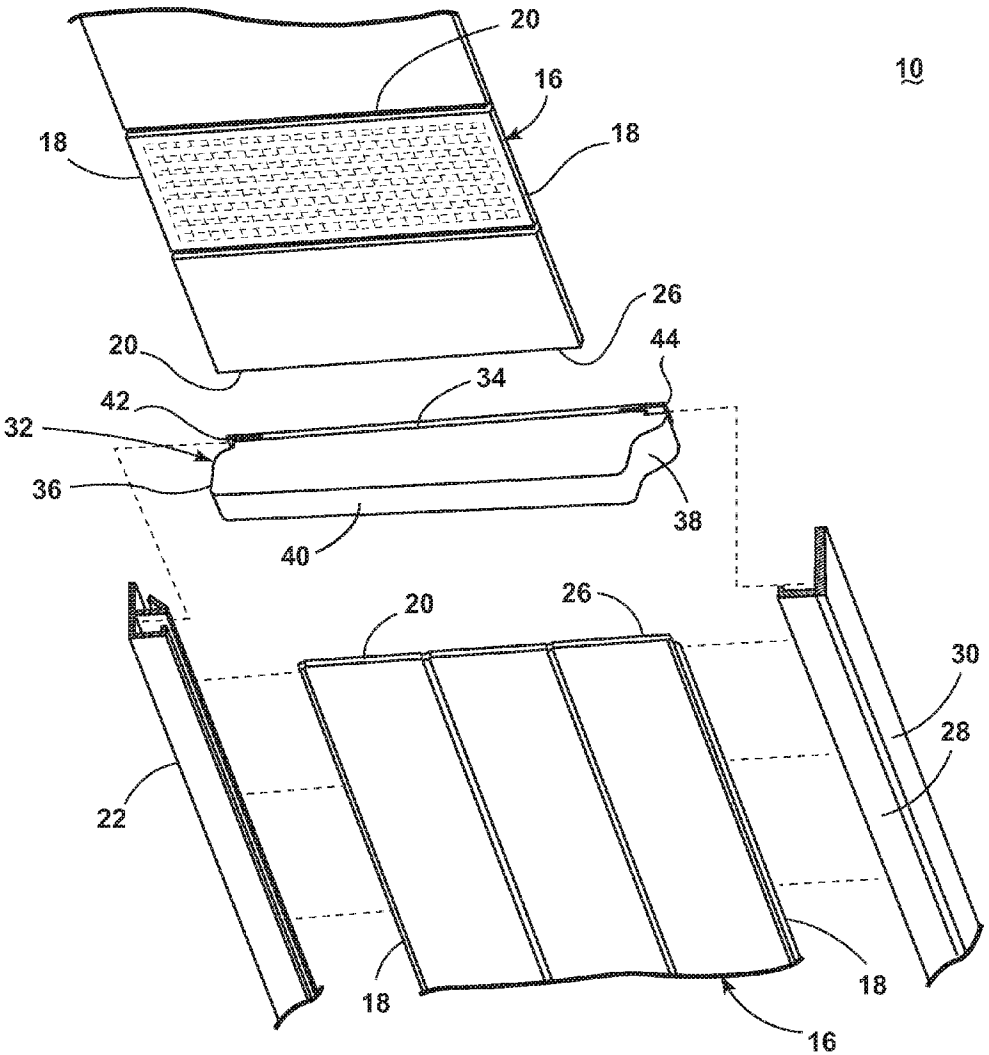
FIG. 3 is an exploded bottom perspective view of a roofing corbel and soffit assembly.

Referring to FIGS. 1-3, reference numeral 10 generally designates a soffit enclosure for a roof 12 of a building 25 and the like of the type having at least one eave 14 with a plurality of soffit panels 16 disposed thereunder. A plurality of generally flat soffit panels 16 each have a generally rectangular plan configuration. The soffit panels 16 have opposite first marginal edge portions 18 and opposite second marginal edge portions 20, and are shaped to enclose at least a portion of the soffit enclosure 10 when mounted in a generally horizontal orientation under the at least one eave 14. A first mounting member 22 is shaped to be attached to an adjacent exterior wall 24 of the building 25, and is configured to support thereon one of the first marginal edge portions 18 of the soffit panels 16 in a manner wherein the adjacent second marginal edge portions 20 of the soffit panels 16 come together along joint lines 26 oriented generally perpendicular to the lengthwise dimension of the soffit enclosure 10. A roof fascia 30 includes a second mounting member 28 which is configured to support thereon the other of the first marginal edge portions 18 of the soffit panels 16.

In addition, the soffit enclosure 10 includes at least one corbel member 32 that has a generally flat upper mounting portion 34 with first and second opposite end edges 36, 38. The soffit enclosure 10 also includes a decorative lower portion 40 shaped to enhance the appearance of the eave 14 of the building 25. First and second rigid hanger tabs 42, 44 are disposed above and generally parallel with the upper mounting portion 34. The first and second rigid hangar tabs 42, 44 project longitudinally from the first and second opposite end edges 36, 38, respectively, of the upper mounting portion 34 and are configured for sequentially inserting into the first and second mounting members 22, 28 at a location overlying adjacent ones of the second marginal edge portions 20 of the soffit panel 16 to conceal the joint 26 disposed therebetween.

Referring again to FIG. 1, the building 25 includes the exterior wall 24 and the roof 12, which protrudes over the exterior wall 24 to define the at least one eave 14. The roof fascia 30 extends along the lower edge of the roof 12, and depends downwardly therefrom. The soffit panels 16, which may be vented or solid, are positioned in a side-by-side and/or an end-to-end relationship beneath an overhang or the eave 14. The soffit panels 16 extend between the fascia 30 and the exterior wall 24 to enclose the underside of the eave 14, defining the soffit enclosure 10, which communicates with an attic of the building 25. Additionally, as shown in FIG. 2, it should be understood by one skilled in the art that the soffit panels 16 can be positioned to extend along a width (W) of the at least one eave 14 in a side-by-side relationship, or along a length (L) of the at least one eave 14 in an end-to-end relationship. The soffit panels 16 are supported by the first and second mounting members 22, 28 in a similar fashion, regardless of their orientation.

The soffit panel 16 can have an integrally formed, one-piece construction, and can be made from metal, such as aluminum or the like, or synthetic materials, such as vinyl. Further, the soffit panel 16 may include vent channels, or other forms of vents, such as elongate slits, rectangular windows, and the like to permit air to pass therethrough.

Figure 4:
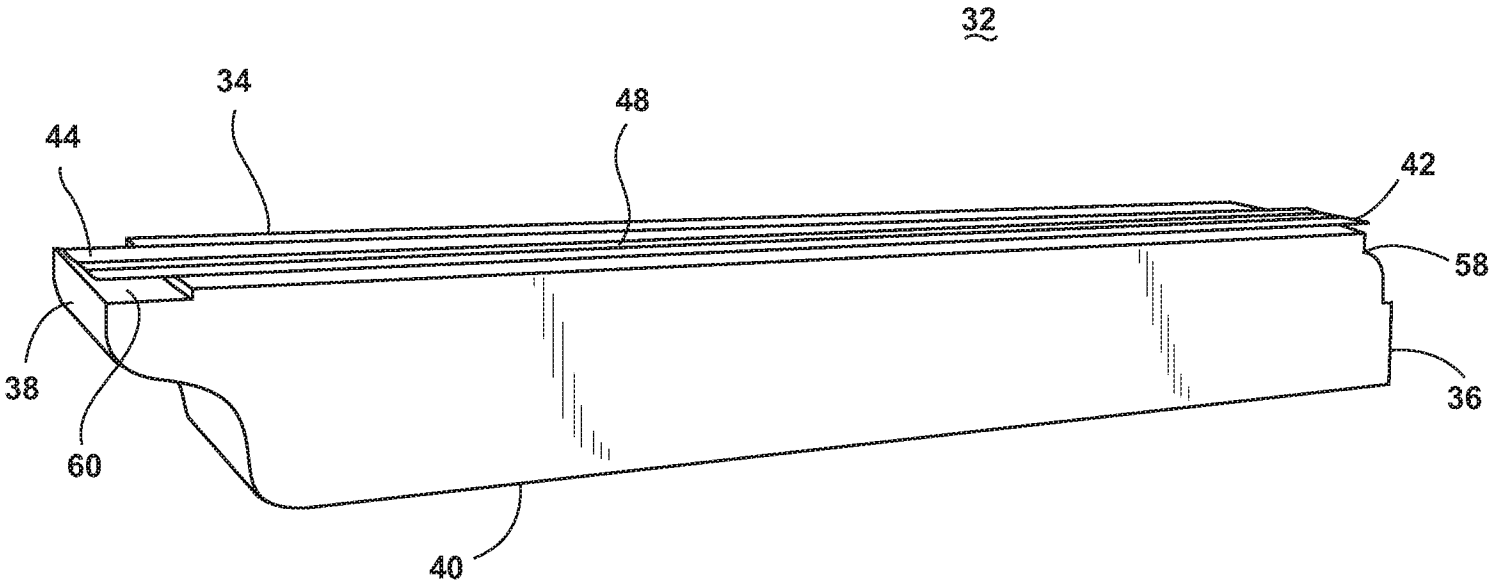
FIG. 4 is a top perspective view of a roofing corbel.
Figure 5:
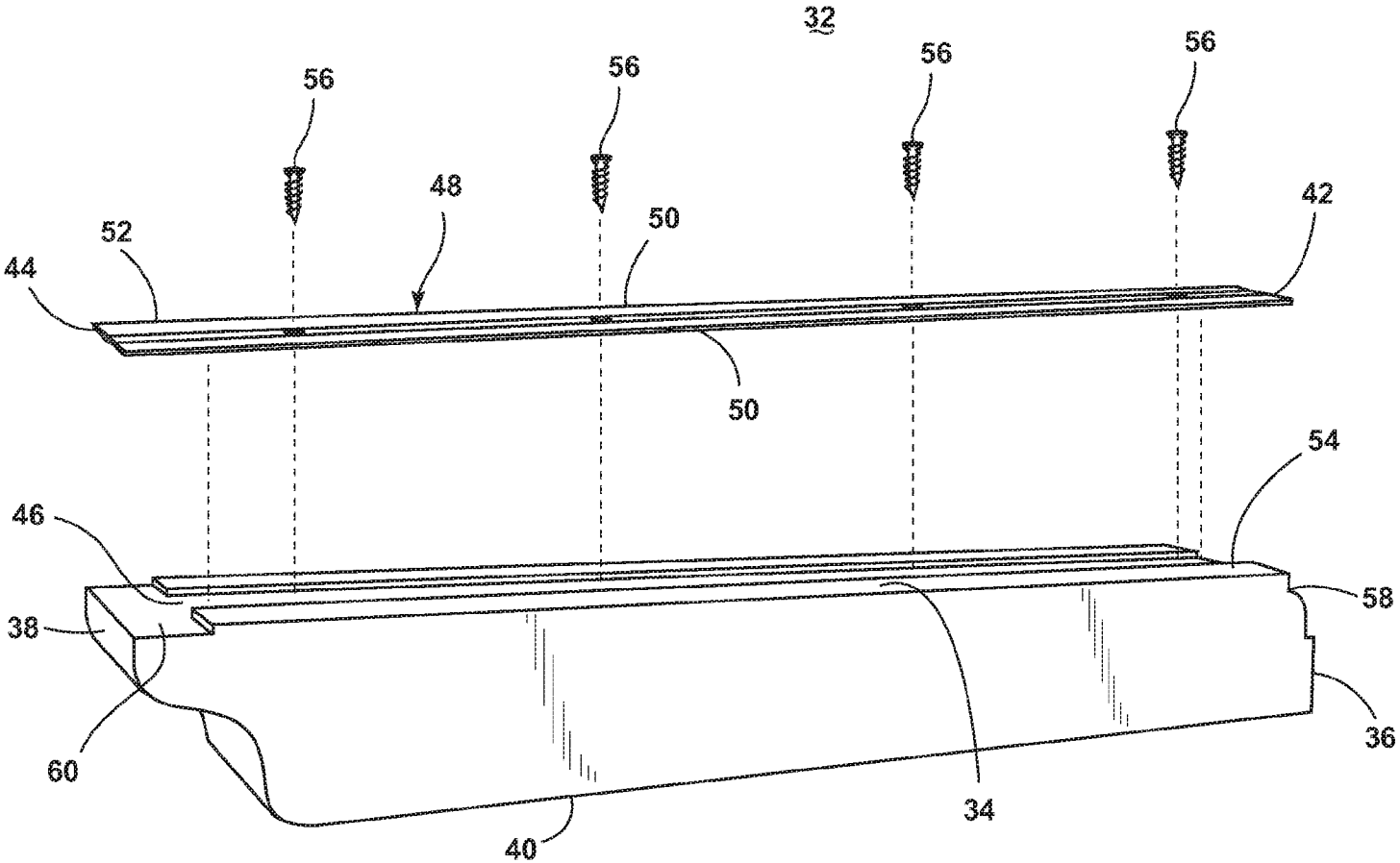
FIG. 5 is a top perspective view of the roofing corbel of FIG. 4 with a strip member removed.
Figure 6:
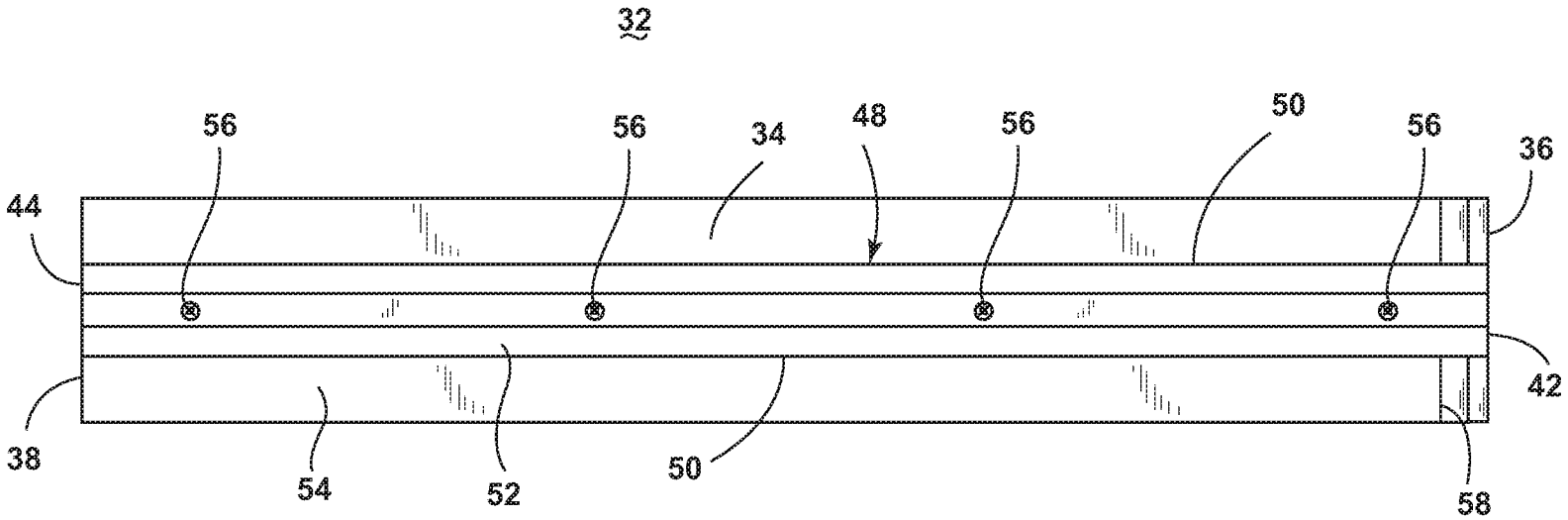
FIG. 6 is a top plan view of the roofing corbel of FIG. 4.
Figure 8:
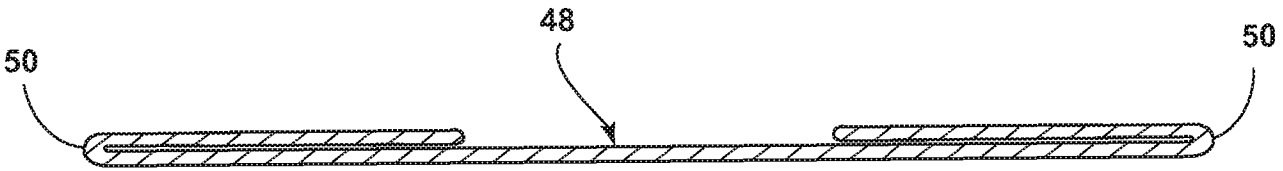
FIG. 8 is a side elevational view of the strip member of the roofing corbel of FIG. 4.

Referring now to FIGS. 4-6, the corbel member 32 has a predetermined length which can be pre-cut or cut to length in the field, and which is generally commensurate with the widthwise (W) distance between the first and second mounting members 22, 28. The corbel member 32 includes a groove 46 in the upper mounting portion 34 in which a strip member 48 is disposed. The strip member 48 is a generally flat, elongate member, from which the first and second rigid hanger tabs 42, 44 extend. Further, the strip member 48 has a length that is generally commensurate with the length of the corbel member 32 and includes folded lateral edges 50, resulting in a double layer of material along the lateral edges 50, as can be seen in FIG. 8, providing additional rigidity to the strip member 48. An abutting surface 52 of the strip member 48 is substantially coplanar with an abutting surface 54 of the upper mounting portion 34 of the corbel member 32. The strip member 48 can be affixed to the corbel member 32 by any suitable means, including threaded fasteners 56. Although threaded fasteners 56 are illustrated, other known means including adhesives and other forms of mechanical fasteners are contemplated.

Figure 7B:
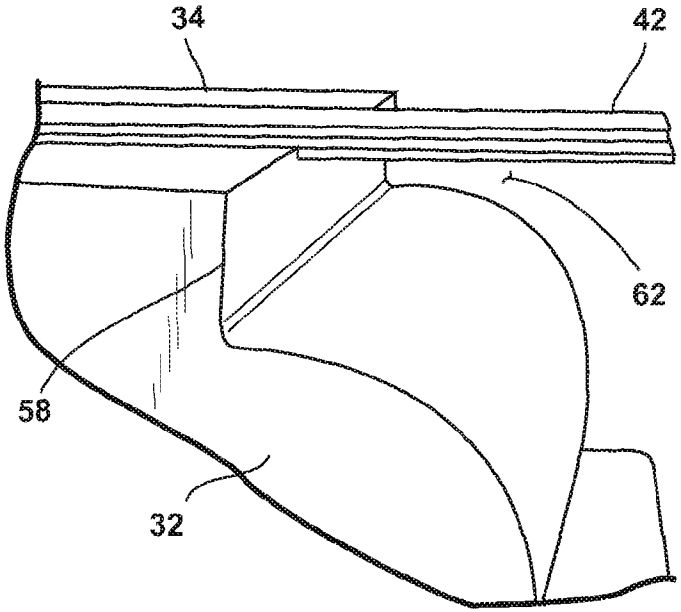
FIG. 7B is a side perspective view of a hanger tab on a second end of the roofing corbel of FIG. 4.
Figure 7A:
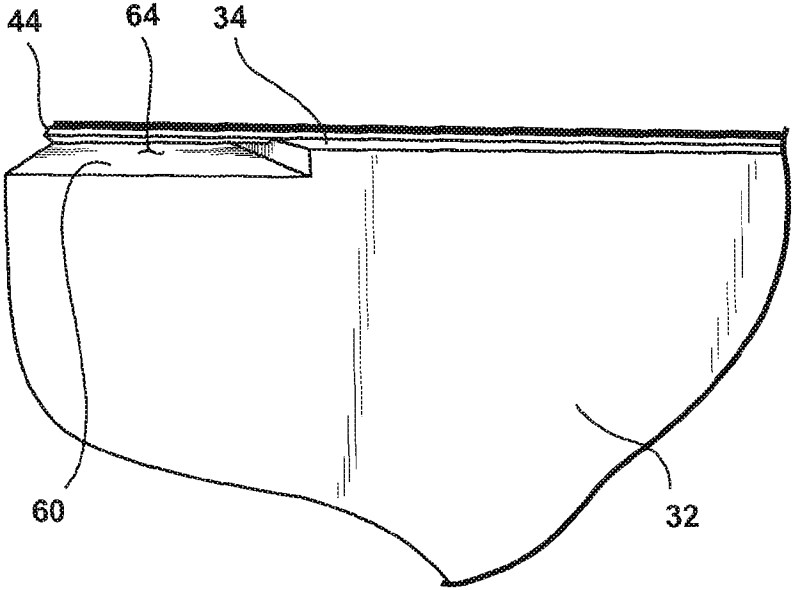
FIG. 7A is a side perspective view of a hanger tab on a first end of the roofing corbel of FIG. 4.

Referring to FIGS. 4 and 7A-7B, the corbel member 32 as illustrated includes first and second stepped portions 58, 60. The stepped portions 58, 60 are disposed in the body of the corbel member 32 and extend laterally along the first and second opposite end edges 36, 38. First and second spaces 62, 64 are defined as the area between the stepped portions 58, 60 and the first and second rigid hanger tabs 42, 44. Additionally, the first and second opposite end edges 36, 38 are contoured. Specifically, first opposite end edge 36 is contoured to complement a profile of the first mounting member 22 and a portion of the exterior wall 24, and the second opposite end edge 38 is contoured to add a decorative element to the appearance of the at least one eave 14 of the building 25.

Figure 9:
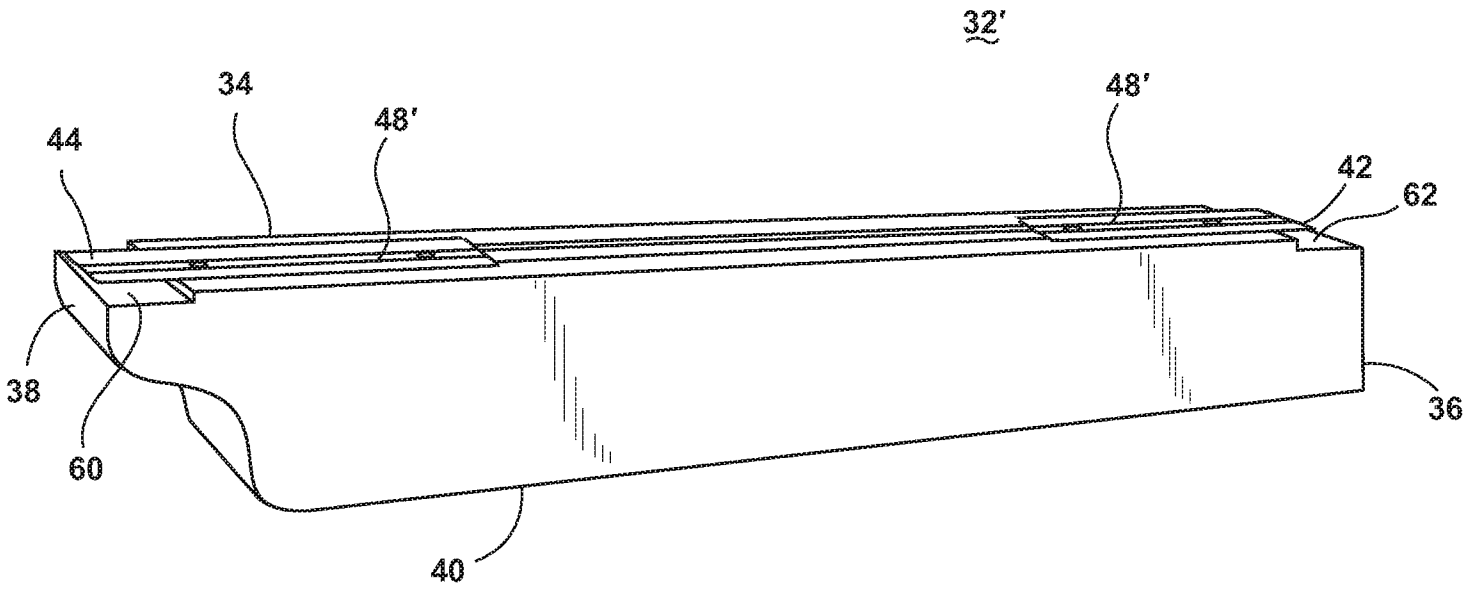
FIG. 9 is a top perspective view of one embodiment of a roofing corbel having two strip members.

Referring now to FIG. 9, another embodiment of a corbel member 32' is illustrated. The corbel member 32' is substantially similar to the corbel member 32 of the previous embodiment, but includes two separate, smaller strip members 48' disposed in the groove 46 and affixed thereto by any of the fixing manners described above. The two strip members 48' include first and second rigid hanger tabs 42, 44 that are positioned in alignment with the first and second opposite end edges 36, 38. Accordingly, the strip members 48' function in the same manner as described above with respect to the single strip member 48.

Referring again to FIG. 9, it is also contemplated that the corbel members 32, 32' may include any suitable contour on the first and second opposite end edges 36, 38. As can be seen in the example illustrated in FIG. 9, first opposite end edge 36 has a planar end, so as to complement a profile of the first mounting member 22 and a portion of the exterior wall 24. Second opposite end edge 38 may include a variety of decorative contours, and the geometries of the first and second opposite end edges 36, 38, as illustrated, are for exemplary purposes only.

As described above, the soffit panels 16 are installed in a conventional manner and are supported on the opposite first and second marginal edge portions 18, 20 by the first and second mounting members 22, 28. With the soffit panels 16 in position, the corbel member 32 can be installed and covers substantially all of the joint lines 26 between adjacent soffit panels 16. When the corbel member 32 is installed, the first and second rigid hanger tabs 42, 44 are configured to receive portions of the first and second mounting members 22, 28 within the first and second spaces 62, 64 to securely support the corbel member 32 thereon without separate fasteners.

Figure 10:
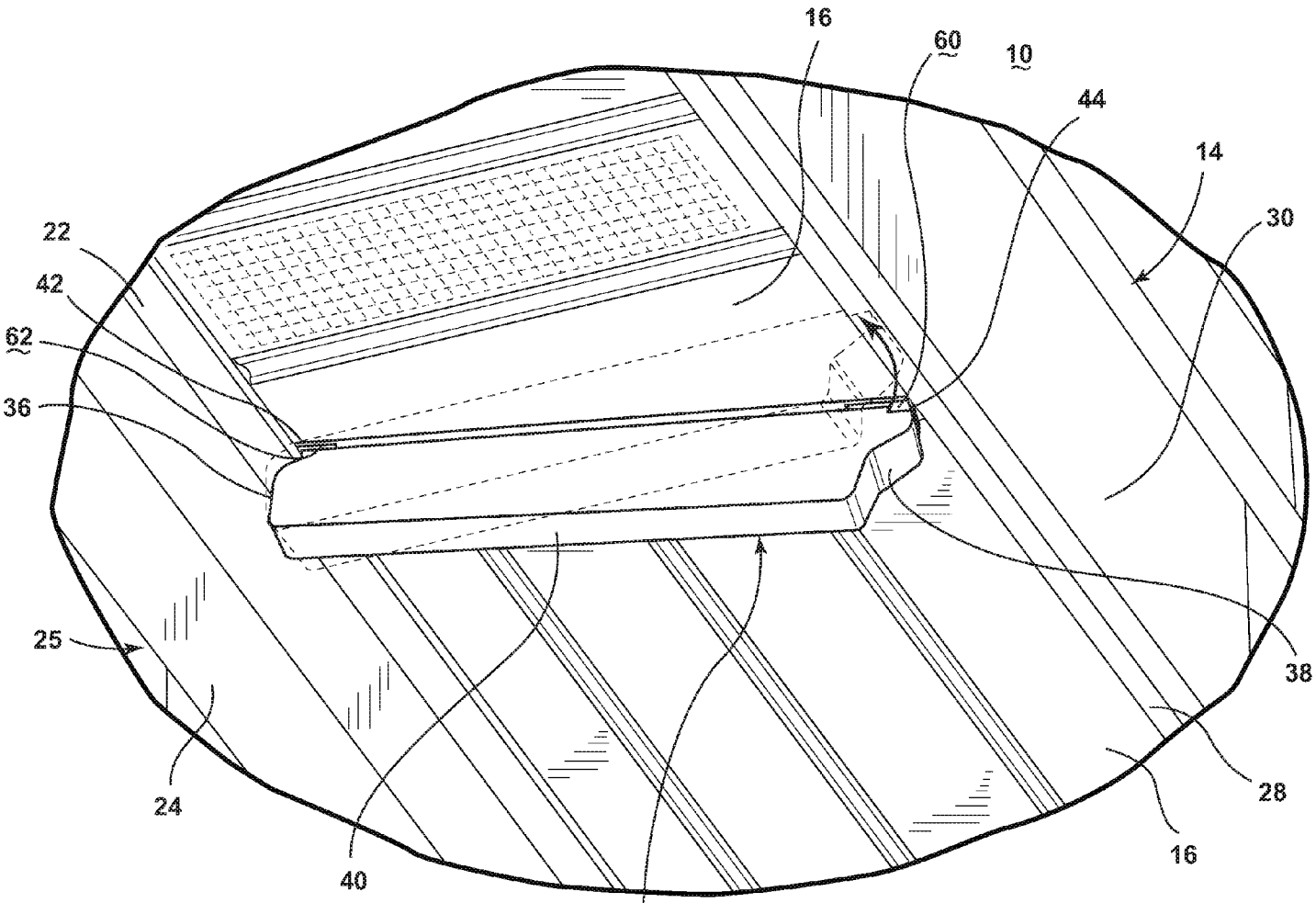
FIG. 10 is an enlarged bottom perspective view of a roofing corbel prior to installation.

Referring to FIG. 10, the corbel member 32 is depicted being installed in a two-part installation process. In an initial installation orientation, the corbel member 32 is skewed relative to the lengthwise (L) dimension of the eave 14 and the first rigid hanger tab 42 is inserted into the first mounting member 22. The corbel member 32 is then rotated generally about the first rigid hanger tab 42 from the skewed initial installation orientation to the fully installed orientation, causing the second rigid hangar tab 44 to be inserted into the second mounting member 28. In the fully installed orientation that is generally perpendicular with the lengthwise (L) dimension of the eave 14, the corbel member 32 is disposed generally parallel with the joint lines 26 so as to conceal the joint lines 26 disposed thereunder. In this manner, the corbel member 32 is secured to the soffit enclosure 10 in a fastenerless twist into place assembly in which the decorative corbel member 32 is supported in a suspended fashion by and between the first and second mounting members 22, 28. It should be easily understood by those skilled in the art that the corbel member 32 may be installed in the opposite order, beginning with installing the second rigid hangar tab 44 into the second mounting member 28. In addition, if desired, any number of corbel members 32 may be installed on the soffit enclosure 10, not just to cover the joint lines 26, as described above. The corbel members 32 add a decorative element to the appearance of the eave 14 of the building 25, and it may be desirable to include a greater number of corbel members 32 for decorative purposes only.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired embodiment and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It will also be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A soffit enclosure for building roofs and the like of the type having at least one soffit panel mounted in a generally horizontal orientation under an associated building eave between a first mounting member attached to an adjacent exterior wall of a building, and an oppositely disposed second mounting member disposed on a roof fascia, the improvement of a decorative corbel comprising:

an upper mounting portion with opposite end edges;

a decorative lower portion shaped to enhance the appearance of the eave of the building; and first and second rigid hanger tabs projecting longitudinally from the opposite end edges of the upper mounting portion and configured for insertion into the first and second mounting members, the first and second rigid hanger tabs being configured such that the first rigid hanger tab is inserted into one of the first and second mounting members with the decorative corbel in an initial installation orientation that is skewed relative to the lengthwise dimension of the building eave, whereby rotation of the decorative corbel generally about the first rigid hanger tab from the skewed initial installation position to a fully installed orientation that is generally perpendicular with the lengthwise dimension of the building eave causes the second rigid hanger tab to be inserted into the other of the first and second mounting members to define a fastenerless twist into place assembly in which the decorative corbel is supported in a suspended fashion by and between the first and second mounting members.

2. The soffit enclosure as set forth in claim 1, wherein the decorative corbel covers substantially all of a joint formed between adjacent soffit panels.

3. The soffit enclosure as set forth in claim 1, further comprising:

first and second stepped portions extending laterally along opposite ends thereof, which define spaces with the first and second rigid hanger tabs in which portions of the first and second mounting members are received to securely support the decorative corbel thereon without separate fasteners.

4. The soffit enclosure as set forth in claim 1, further comprising:

contoured opposite end edges, wherein one opposite end edge is contoured to substantially match a profile of the first mounting member and a portion of the exterior wall of the building, and the other of the opposite end edges is contoured to add a decorative element to the appearance of the eave of the building.

5. The soffit enclosure as set forth in claim 1, wherein one of the end edges is proximate said building and configured to complement a profile of the exterior wall of the building.

6. The soffit enclosure as set forth in claim 1, wherein the upper mounting portion of the decorative corbel includes a groove.

7. A method of installing a decorative corbel for building soffit enclosures and the like of the type having at least one soffit panel mounted in a generally horizontal orientation under an associated building eave between a first mounting member attached to an adjacent exterior wall of a building, and an oppositely disposed second mounting member disposed on a roof fascia, the method comprising:

positioning an upper mounting portion of the decorative corbel proximate the soffit panel;

positioning a decorative lower portion of the decorative corbel in a visible condition to enhance the appearance of the eave of the building; and inserting a first rigid hanger tab of the decorative corbel into one of the first and second mounting members with the decorative corbel in an initial installation orientation that is skewed relative to the lengthwise dimension of the building eave;

rotating the decorative corbel generally about the first rigid hanger tab from the skewed initial installation position to a fully installed orientation that is generally perpendicular with the lengthwise dimension of the building eave; and inserting the second rigid hanger tab into the other of the first and second mounting members to define a twist into place assembly in which the decorative corbel is supported in a suspended fashion by and between the first and second mounting members.

8. The method of claim 7, further comprising:

positioning the decorative corbel to cover substantially all of a joint formed between adjacent soffit panels.

9. A soffit enclosure for building roofs and the like of the type having at least one eave with a soffit thereunder, comprising:

a first mounting member shaped to be attached to an adjacent exterior wall of the building;

a roof fascia of the building having a second mounting member; and at least one corbel member having a generally flat upper mounting portion with opposite end edges, a decorative lower portion shaped to enhance the appearance of the eave of the building, and first and second attachment features projecting longitudinally from the opposite end edges of the upper mounting portion and configured for sequentially engaging into the first and second mounting members at a location overlying adjacent soffit panels to conceal a joint disposed therebetween;

wherein the at least one corbel member includes contoured opposite end edges, wherein one opposite end edge is contoured to complement a profile of the first mounting member and a portion of the exterior wall of the building, and the other of the opposite end edges is contoured to add a decorative element to the appearance of the eave of the building.

10. The soffit enclosure as set forth in claim 9, wherein the first and second attachment features define first and second rigid hanger tabs configured such that the first rigid hanger tab is inserted into one of the first and second mounting members with the at least one corbel member in an initial installation orientation that is secured relative to the joint, whereby rotation of the at least one corbel member generally about the first rigid hanger tab from the initial installation position to a fully installed orientation that is generally parallel with the joint inserts the second rigid hanger tab into the other of the first and second mounting members to define a fastenerless twist into place assembly.

11. The soffit enclosure as set forth in claim 9, wherein the at least one corbel member includes first and second stepped portions extending laterally along opposite ends thereof that define spaces with the first and second attachment features in which portions of the first and second mounting members are received to securely support the at least one corbel member thereon without separate fasteners.

* * * * *